US008819867B1

(12) United States Patent
Boada

(10) Patent No.: US 8,819,867 B1
(45) Date of Patent: Sep. 2, 2014

(54) WEIGHTED SKULL CAP

(76) Inventor: Carlos A. Boada, Mountain Home, ID (US)

( * ) Notice: Subject to any disclaimer, the term of this patent is extended or adjusted under 35 U.S.C. 154(b) by 315 days.

(21) Appl. No.: 12/815,625

(22) Filed: Jun. 15, 2010

(51) Int. Cl.
*A42B 1/24* (2006.01)

(52) U.S. Cl.
USPC ..... 2/171.2; 2/171

(58) Field of Classification Search
USPC ..... 2/171.2, 171.4, 171.5, 181, 181.4, 2/209.13, 200.1; 482/105, 10, 92; 601/39
See application file for complete search history.

(56) References Cited

U.S. PATENT DOCUMENTS

| | | | | |
|---|---|---|---|---|
| 4,168,060 | A | 9/1979 | Hohenfeldt | |
| 4,312,076 | A | 1/1982 | Gamm | |
| 4,339,124 | A | 7/1982 | Vogler | |
| 4,645,198 | A | 2/1987 | Levenston | |
| 4,988,093 | A | 1/1991 | Forrest, Sr. et al. | |
| 5,289,591 | A * | 3/1994 | Andersen | 2/411 |
| 5,630,230 | A * | 5/1997 | Fujino et al. | 2/200.1 |
| 5,887,289 | A * | 3/1999 | Theoret | 2/425 |
| 6,000,066 | A | 12/1999 | Williams | |
| 6,094,749 | A * | 8/2000 | Proctor | 2/195.2 |
| 6,110,080 | A | 8/2000 | Niv | |
| 6,112,332 | A * | 9/2000 | McCormick | 2/181 |
| 6,282,721 | B1 * | 9/2001 | Travalgia | 2/171 |
| 6,671,887 | B1 * | 1/2004 | Eligan et al. | 2/228 |
| 6,692,413 | B1 * | 2/2004 | Greenberg et al. | 482/105 |
| 6,857,134 | B1 * | 2/2005 | Cowell | 2/209.13 |
| 7,010,814 | B2 | 3/2006 | Benziger | |
| 7,043,761 | B2 * | 5/2006 | Epling | 2/7 |
| D566,799 | S | 4/2008 | Flavell et al. | |
| 7,376,979 | B2 * | 5/2008 | Nilsen | 2/69 |
| 8,062,194 | B2 * | 11/2011 | Weiss | 482/105 |
| 2003/0073549 | A1 | 4/2003 | Hatch | |
| 2003/0092544 | A1 * | 5/2003 | Reed | 482/105 |
| 2003/0230613 | A1 * | 12/2003 | Karenga | 224/602 |
| 2004/0132589 | A1 * | 7/2004 | Zajac et al. | 482/105 |
| 2005/0085162 | A1 * | 4/2005 | Ott | 450/150 |
| 2005/0257313 | A1 * | 11/2005 | Hageman | 2/422 |
| 2005/0277491 | A1 * | 12/2005 | Nolan | 473/451 |
| 2006/0123526 | A1 * | 6/2006 | Lim | 2/181 |
| 2007/0099774 | A1 * | 5/2007 | Bruback | 482/105 |
| 2008/0010721 | A1 * | 1/2008 | Campbell et al. | 2/181.4 |
| 2008/0034473 | A1 * | 2/2008 | Wong | 2/181 |
| 2008/0163407 | A1 * | 7/2008 | Gardner | 2/209.13 |
| 2008/0198579 | A1 * | 8/2008 | Crye et al. | 362/106 |
| 2008/0280737 | A1 * | 11/2008 | Cook | 482/105 |

* cited by examiner

*Primary Examiner* — Khoa Huynh
*Assistant Examiner* — Andrew W Collins
(74) *Attorney, Agent, or Firm* — Robert C. Montgomery; Montgomery Patent & Design

(57) ABSTRACT

A weighted skull cap comprising integral weights for strengthening neck muscles during sport or physical therapy activities is herein disclosed. The apparatus comprises multiple layers that conceal a plurality of individual pockets about an entire interior surface of the cap. Each pocket comprises a flap-style locking closure for placement of a weight and secured with a fastening means to assist in retaining the weights therein the pockets during exercise activities. Each weight quantity is varied by the user to suit individual training needs.

19 Claims, 6 Drawing Sheets

WEIGHTED SKULL CAP

RELATED APPLICATIONS

The present invention was first described in a notarized Official Record of Invention on Sep. 18, 2008, that is on file at the offices of Montgomery Patent and Design, LLC, the entire disclosures of which are incorporated herein by reference.

FIELD OF THE INVENTION

The present invention relates generally to skull cap type headwear, and in particular, to headwear particularly adapted to therapeutic and strength training headwear adapted for exercising or training neck and head muscles.

BACKGROUND OF THE INVENTION

The head and neck contain many muscles which are utilized and strained on a daily basis. Neck pains are one of the most common forms of physical muscular distress experienced on a general basis, as the neck is subjected to many forms of duress during a common daily routine including craning from side to side for sight purposes, improper support due to poor sitting and standing postures, angled pressure experienced while sleeping, rapid movement during exercise and sporting events, and the like.

Despite the prevalence of neck discomforts and ailments, there are few commonly employed exercise devices utilized for purposes of strengthening and training the neck muscles, or for providing therapeutic benefits in the case where neck strain has already become an issue. This is in contrast to many portions of the human body, where common muscle training implements are well known and in widespread use.

Various attempts have been made to provide neck exercising apparatuses. Examples of these attempts can be seen by reference to several U.S. patents. U.S. Pat. No. 4,168,060, issued in the name of Hohenfeldt, describes a physical conditioning apparatus which combines headgear and jump-rope type ropes and grips in order to provide combined exercise capabilities to both the wrist and neck muscles.

U.S. Pat. No. 4,988,093, issued in the name of Forrest, Sr. et al., describes a fluid-filled neck exerciser. The Forrest, Sr. apparatus utilizes fluid filling means for air, water, or the like in order to provide exercise functionality to the integral headwear.

U.S. Pat. No. 6,000,066, issued in the name of Williams, describes an exercise helmet. The Williams apparatus allows a user to attach conventional dumbbell type weights to the apparatus in order to provide weight resistance capabilities.

Additionally, ornamental designs for a neck trainer exist, particularly U.S. Pat. No. D 566,799. However, none of these designs are similar to the present invention.

While these devices fulfill their respective, particular objectives, each of these references suffer from one (1) or more of the aforementioned disadvantages. Many such apparatuses are not adaptable to a wide range of training applications. In addition, many such apparatuses are unintuitive or uncomfortable to a user. Furthermore, many such apparatuses do not provide any peripheral benefits. Accordingly, there exists a need for a neck training apparatus without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide headgear adapted for neck training exercises which provides comfort and customizability, as well as peripheral benefits such as similarities and uses as conventional headgear and aesthetic benefits commonly found in other types of exercise apparatuses. Thus, the object of the present invention is to solve the aforementioned disadvantages and provide for this need.

To achieve the above objectives, it is an object of the present invention to provide a means to strengthen neck muscles for the purposes of sports, physical therapy, and other fitness related activities comprising an outer cap, an inner cap, a plurality of pockets, and a plurality of weights. The overall apparatus takes the form of a conventional skull cap.

Another object of the present invention is to provide a removable inner cap which provides easy use, customization, and conventional headgear functionality. The inner cap is attachable removable from the outer cap by means of a conventional fastener. In a preferred embodiment, the inner cap comprises a plurality of loop fasteners which correspond with a plurality of hook fasteners located on an inner surface of the outer cap.

Yet still another object of the present invention is to provide a secure fit and secure weighting means to the apparatus by comprising a plurality of pockets, a plurality of straps, and a stretchable band. The inner cap is further fabricated of a mesh material to provide a comfortable stretching fit and to prohibit movement from the addition of weights.

Yet still another object of the present invention is to provide features associated with conventional recreational headgear. The outer cap provides conventional features of a skull cap, snow hat, or the like by comprising a conventional fabric surface, a plurality of apertures for ventilation, and the like.

Yet still another object of the present invention is to provide integral attachment to the plurality of pockets via the plurality of straps which radiate downwardly from the top center of the outer cap. The pockets are integrally sewn to the straps via conventional sewing techniques to provide a stabilizing means for the pockets and enclosed weights.

Yet still another object of the present invention is to provide secure housing to the weights via the pockets. The pockets comprise a conventional rectangular envelope type pocket, further comprising a rectangular portion into which a weight is inserted and a pocket flap which is selectively fastened to the pocket by means of a conventional fastener.

Yet still another object of the present invention is to provide a secure fit to a user's head by means of the stretchable band, which comprises a conventional elastic band integrally located at a lower end portion of the outer cap.

Yet still another object of the present invention is to provide aesthetic features particularly adapted for comfort during exercise activities. The inner cap is fabricated from a moisture-wicking synthetic material which provides absorption of moisture away from a user's head during use in order to keep the user's head cool and dry.

Yet still another object of the present invention is to provide user-customizable exercise configurations by means of a plurality of rectangular weights adapted to fit inside of the pockets. The weights may be selectively placed in any number, configuration and weight among the plurality of pockets to provide a desired resistance strength training experience.

Yet still another object of the present invention is to provide a method of utilizing the device that provides a unique means of selectively placing weights within the pockets of the outer cap in a desired manner, securing the pocket flaps to hold the weights in place, placing the inner cap securely within the outer cap via the hook and loop fasteners to provide further securing of the weights as well as comfort features for moisture absorption and padding, and comfortably securing the apparatus on a user's head in the manner of conventional headgear with added stability provided by the stretchable band.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
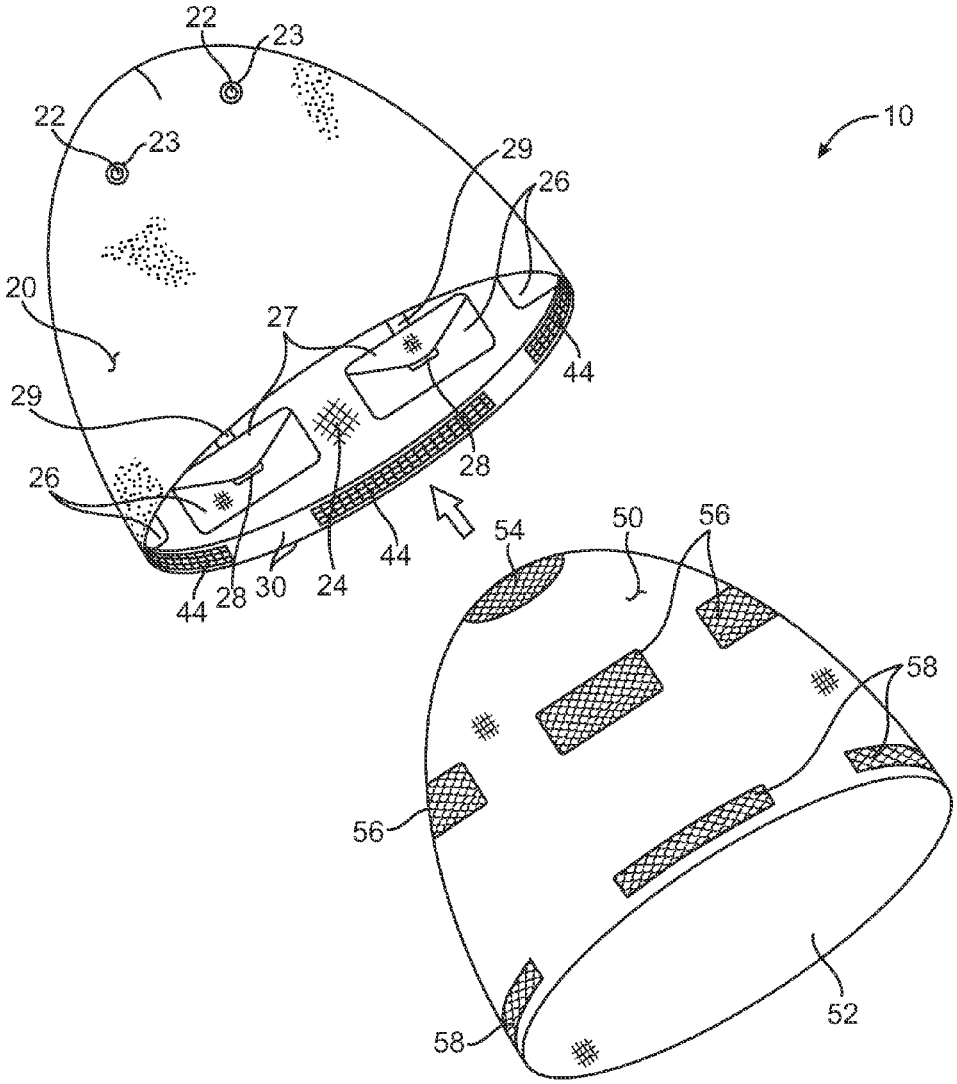
FIG. 1 is a perspective view of a weighted skull cap 10 depicting a disassembled state, according to a preferred embodiment of the present invention.

10 weighted skull cap
20 outer cap
21 outer cap surface
22 aperture
23 grommet
24 interior portion
26 pocket
27 pocket flap
28 pocket fastener
29 strap
30 stretchable band
40 top hook fastener
42 middle hook fastener
44 bottom hook fastener
50 inner cap
51 inner cap surface
52 interior inner cap
54 top loop fastener
56 middle loop fastener
58 bottom loop fastener
60 weight
62 weight body
70 sewing technique
80 additional securing means
85 additional fastener
87 securing device
89 securing material

DETAILED DESCRIPTION OF THE PREFERRED EMBODIMENT

Figure 4:
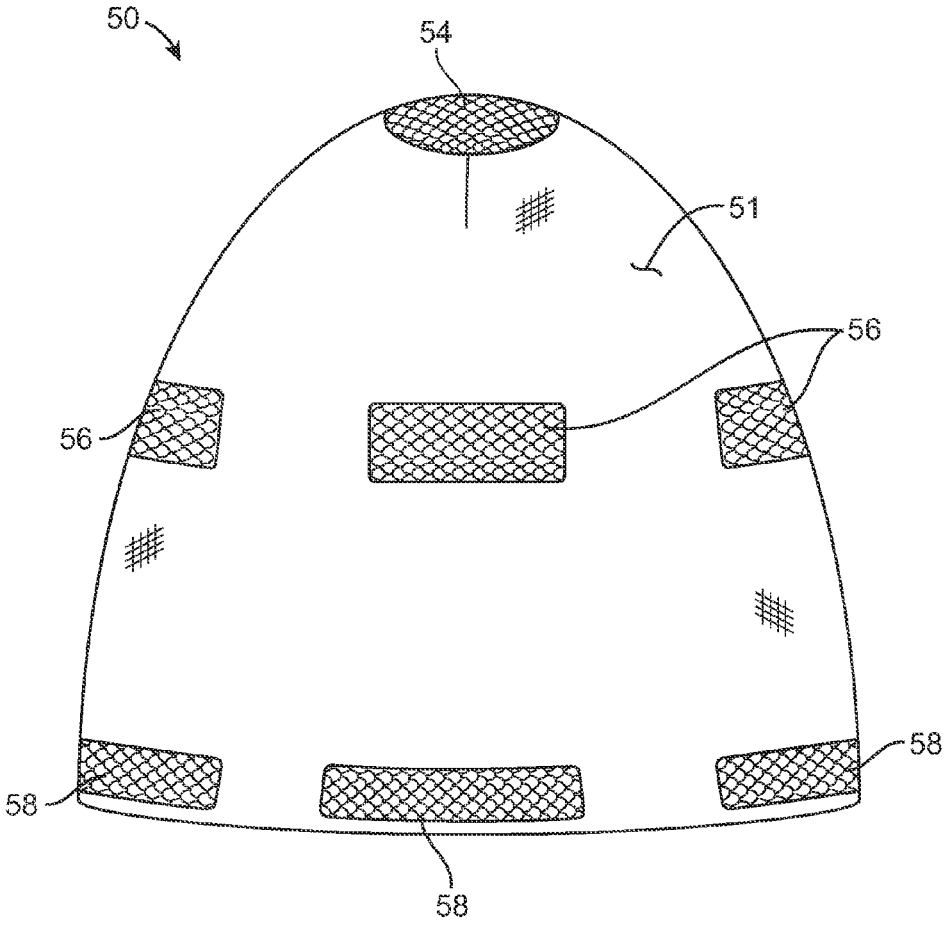
FIG. 4 is a front view of an inner cap 50, according to a preferred embodiment of the present invention.
Figure 5:
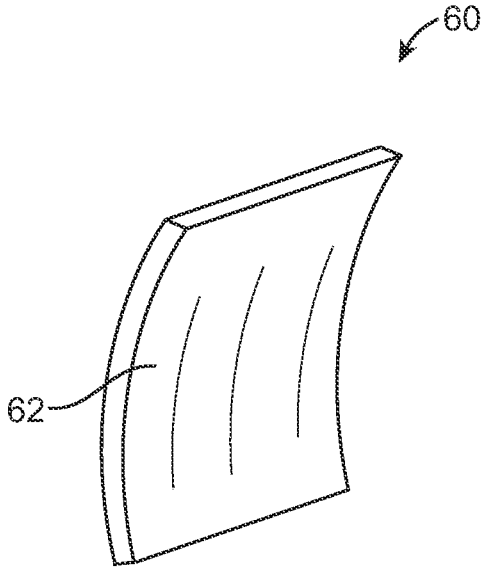
FIG. 5 is a front view of a weight 60, according to a preferred embodiment of the present invention; and, FIG. 6 is a rear perspective view of the outer cap 20 depicting an alternate securing means 80, according to an alternate embodiment of the present invention.
Figure 6:
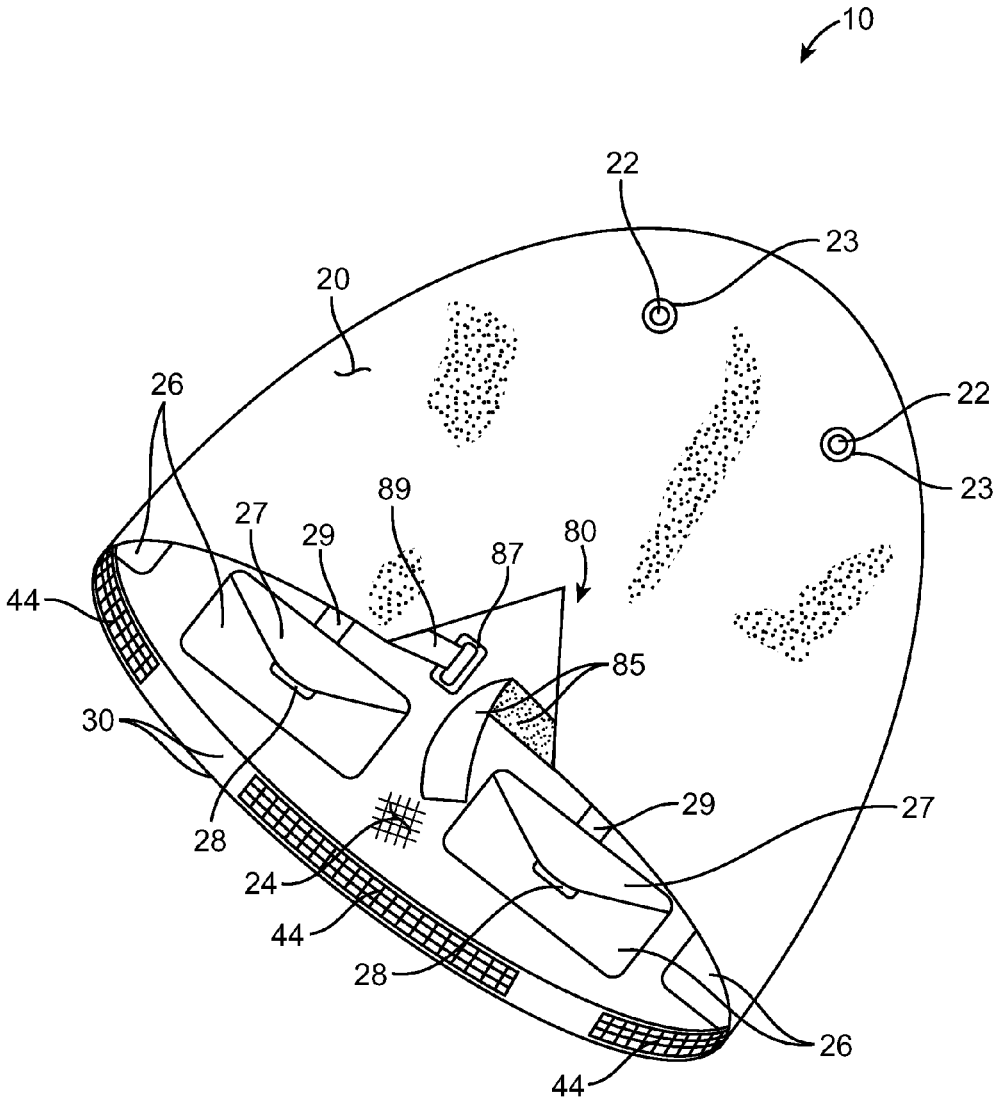

The best mode for carrying out the invention is presented in terms of its preferred embodiment, herein depicted within FIGS. 1 through 5 and alternately within FIG. 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a weighted skull cap (herein described as the "apparatus") 10, which provides a means to strengthen neck muscles for the purpose of sports, physical therapy, or other fitness related activity. Said apparatus 10 comprises an outer cap 20, a plurality of pockets 26, an inner cap 50, and a plurality of weights 60. Said apparatus 10 allows a user the ability to strengthen their neck muscles in a quick, easy and effective manner so that increased dexterity and speed can be realized during other sporting activities.

Referring now to FIG. 1, a perspective view of the apparatus 10 depicting a disassembled state, according to the preferred embodiment of the present invention, is disclosed. The apparatus 10 comprises an outer cap 20 and inner cap 50 which are removably attachable from one (1) another therewith a conventional fastening technique as mentioned herein below. The detachability of the apparatus 10 enables the user to add or remove weights 60 as desired. An interior portion 24 of the outer cap 20 comprises a plurality of integral pockets 26, thereby providing an enclosure for a desired amount of weights 60. The inner cap 50 comprises a plurality of loop fasteners 54, 56, 58 (also see FIG. 4) which operate in conjunction with a plurality of hook fasteners 40, 42, 44 (also see FIG. 3) thereon the outer cap 20.

Figure 2:
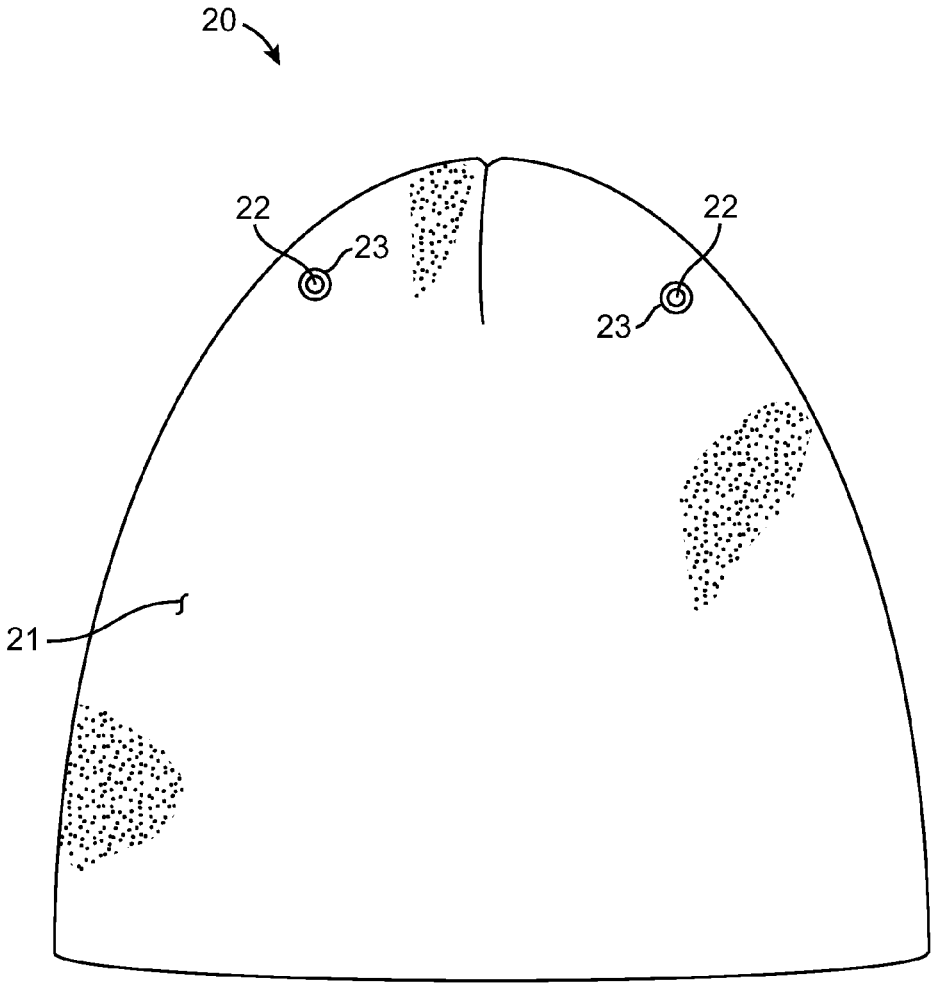
FIG. 2 is a front view of an outer cap 20, according to a preferred embodiment of the present invention.

Referring now to FIG. 2, a front view of an outer cap 20, according to the preferred embodiment of the present invention, is disclosed. The outer cap 20 takes the form of a conventional skull cap, snow hat, or the like. Said outer cap 20 comprises an outer cap surface 21 which is preferably fabricated from a fleece material, yet other material may be utilized without limiting the functions of the apparatus 10. Said outer cap surface 21 may further comprise script or logos based upon a user's preference and may include images such as, but not limited to: sports names/logos, personal names, symbols, pictures, and the like to further customize and personalize the apparatus 10 further comprising a variety of colors and patterns.

The outer cap 20 also comprises a plurality of apertures 22, thereby providing ventilation to the apparatus 10. At least two (2) apertures 22 are provided thereon an upper portion of each side of the apparatus 10. Said apertures 22 are preferably reinforced with a grommet 23, thereby preventing damage to the apparatus 10. Each aperture 22 measures an appropriate diameter to maximize the flow of air into the apparatus 10.

Figure 3:
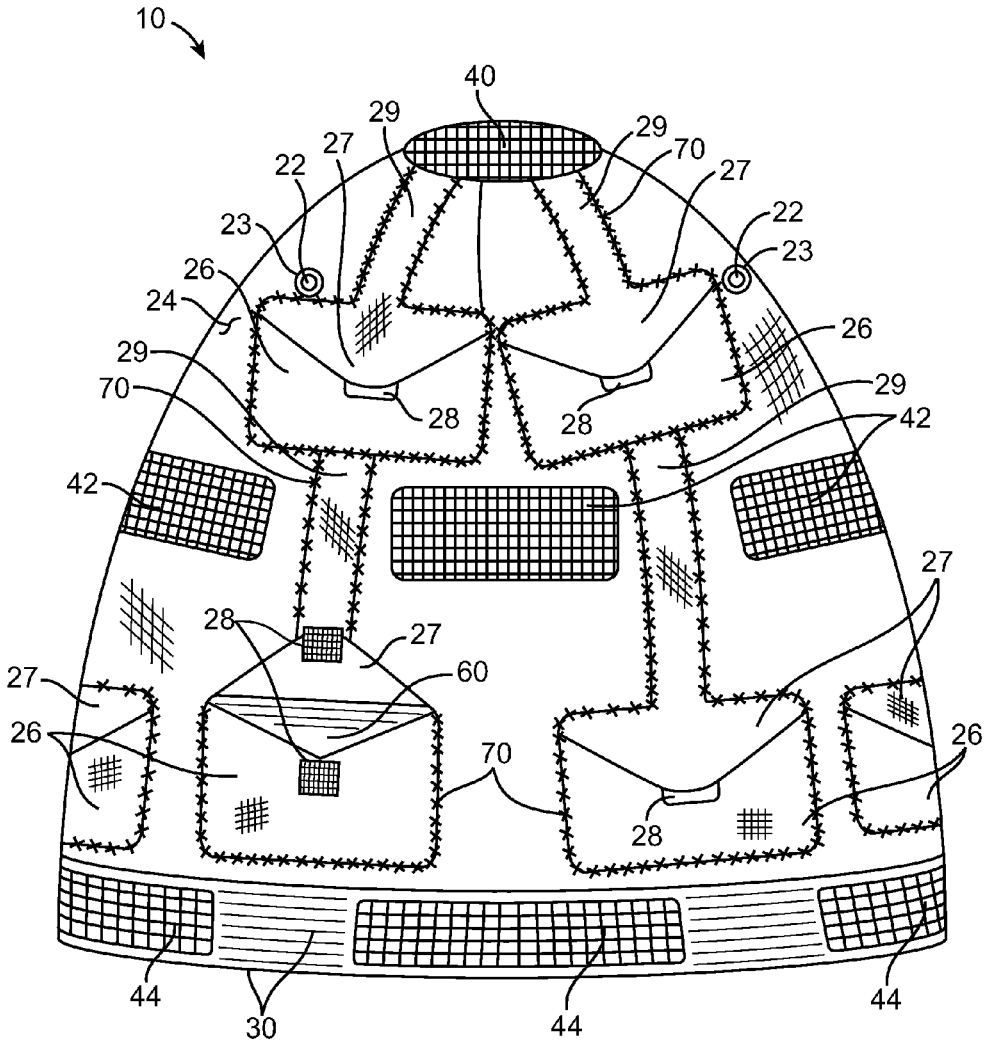
FIG. 3 is a front view of an inner portion of the outer cap 20, according to a preferred embodiment of the present invention.

Referring now to FIG. 3, a front view of an inner portion of the outer cap 20, according to the preferred embodiment of the present invention, is disclosed. The interior portion 24 of the outer cap 20 comprises a plurality of pockets 26, a plurality of straps 29, a stretchable band 30, a top hook fastener 40, a plurality of middle hook fasteners 42, and a plurality of bottom hook fasteners 44. Said interior portion 24 is preferably fabricated from a mesh material, thereby prohibiting movement from the addition of weights 60, yet other materials may be utilized without limiting the functions of the apparatus 10.

Said outer cap 20 and comprises a top hook fastener 40, a middle hook fastener 42, and a bottom hook fastener 44, thereby providing an attachment means for said outer cap 20 thereto the inner cap 50 (also see FIG. 4). Each hook fastener 40, 42, 44 is preferably the hook side of a conventional hook-and-loop fastener, yet other fastening means may be utilized such as, but not limited to: adhesives, buttons, latches, or the like without limiting the functions of the apparatus 10. The top hook fastener 40 is located thereon the pinnacle portion of the interior portion 24 and takes the form of a circular or rectangular member. The middle hook fasteners 42 encompass an intermediate portion of the interior portion 24 and are preferably rectangular in shape, yet other shapes may be incorporated without limiting the functions of the apparatus 10. The interior portion 24 comprises up to eight (8) middle hook fasteners 42. The bottom hook fasteners 44 are located thereon a bottom portion of the outer cap 20 and also take on a shape similar thereto the middle loop fasteners 42. The interior portion 24 also comprises up to eight (8) bottom hook fasteners 44. Each hook fastener 40, 42, 44 engages and mates to a corresponding loop fastener 54, 56, 58 (also see FIG. 4).

The interior portion 24 of the outer cap 20 also comprises a plurality of straps 29. Each strap 29 comprises a pocket 26, a pocket flap 27, and a pocket fastener 28. Said straps 29 downwardly radiate from the pinnacle top portion and the apparatus 10 which are attached to the interior portion 24 therewith conventional sewing techniques 70. Said straps 29 restrain each pocket 26, thereby securing said pocket 26 to the interior portion 24 which prohibits movement to the user inserted weights 60. Each distal end portion of each strap 29 comprises a pocket 26. The interior portion 24 comprises up to twelve (12) straps 29 hence the interior portion also comprises up to twelve (12) corresponding pockets 26. The straps 29 and pockets 26 are preferably fabricated from a stabilizing material sewn into the interior portion 24 therewith conventional sewing techniques 70 as above-mentioned.

Each pocket 26 comprises a pocket flap 27 and pocket fastener 28, thereby providing a secure housing to weights 60. Each pocket 26 takes the form of a conventional rectangular envelope, yet other forms may be provided without limiting the functions of the apparatus 10. In use, a triangular pocket flap 27, located thereon the top half of each pocket 26 is lifted upwardly, thereby unfastening the pocket fastener 28. Said pocket fastener 28 is preferably hook-and-loop-type fasteners, yet other fasteners such as, but not limited to: buttons, zippers, or the like may be incorporated without limiting the functions of the apparatus 10. A weight 60 (also see FIG. 5) is inserted into the pocket 26 and the pocket flap 27 is pressed down thereupon the outer surface of the pocket 26 and the pocket fastener 28 is fastened.

A lower distal portion of the interior portion 24 of the outer cap 20 comprises a conventional stretchable band 30, thereby providing the user with a secure fit of the apparatus 10 to their head. Said stretchable band 30 encompasses the lower distal portion and is preferably fabricated from stretchable materials which comprise elastic properties, yet other materials may be incorporated without limiting the functions of the apparatus 10.

Referring now to FIG. 4, a front view of an inner cap 50, according to the preferred embodiment of the present invention, is disclosed. The apparatus 10 comprises a removably antimicrobial attachable inner cap 50 as abovementioned. Said inner cap 50 is similar in size and shape of the outer cap 20 and comprises a top loop fastener 54, a middle loop fastener 56, and a bottom loop fastener 58, thereby providing an attachment means for said inner cap 50 thereto the outer cap 20. Each loop fastener 54, 56, 58 is preferably the loop side of a conventional hook-and-loop fastener, yet other fastening means may be utilized without limiting the functions of the apparatus 10. The top loop fastener 54 is located thereon the pinnacle portion of the inner cap 50 and takes the form of a circular or rectangular member. Said top loop fastener 50 mates therewith the top hook fastener 40 located thereon the interior portion 24 of the outer cap 20. The middle loop fasteners 56 encompass an intermediate portion of the inner cap 50 and are preferably rectangular in shape, yet other shapes may be incorporated without limiting the functions of the apparatus 10. Said middle loop fastener 56 mates therewith a corresponding middle hook fastener 42 located thereon the interior portion 24 of the outer cap 20. The bottom loop fasteners 58 are located thereon a bottom portion of the inner cap 50 and also take on a shape similar thereto the middle loop fasteners 56. Said bottom loop fastener 58 mates therewith a corresponding bottom hook fastener 44 located thereon the interior portion 24 of the outer cap 20.

Said inner cap 50 is preferably fabricated from a moisture-wicking synthetic material, thereby enabling the absorption of moisture away from the user's cranium keeping said user dry and cool. Other materials may be incorporated for the inner cap 50 without limiting the functions of the apparatus 10. Said inner cap 50 may also be fabricated in a variety of colors and patterns.

Referring now to FIG. 5, a front view of a weight 60, according to the preferred embodiment of the present invention, is disclosed. The apparatus 10 comprises a plurality of rectangular weights 60, one (1) for each pocket 26. The weight body 62 measures appropriate dimensions slightly smaller than that of each pocket 26, thereby enabling said weights 60 to be installed thereinside any pocket 26. Each weight 60 also comprises an arcuate shape, thereby comfortably contouring to the users head. Each weight 60 weighs approximately six-and-four-fifths (6⅘) ounces, thereby providing a user with a maximum additional weight of approximately five-and-one-tenth (5 1/10) pounds. Each weight 60 is fabricated from materials such as, but not limited to: a sand bag, a metal plate, a metal short, or the like.

Referring now to FIG. 6, a rear perspective view of the outer cap 20 depicting an additional securing means 80, according to an alternate embodiment of the present invention, is disclosed. The apparatus 10 may comprise an additional securing means 80, thereby providing a supplementary fastener thereto further secure the outer cap 20 thereto a user's head. Said additional securing means 80 comprises an additional fastener 85, a securing device 87, and a securing material 89. The additional fastener 85 preferably comprises a hook-and-loop fastener, yet other fastening means may be incorporated such as, but not limited to: snaps, buttons, or the like. Said additional fastener 85 is partially secured an inside bottom longitudinal rear portion of the outer cap 20 and secured therewith conventional sewing techniques 70. The partial securing provides one (1) end portion to be freely inserted through a securing device 87 and wrapped around to secure back onto itself. The securing device 87 is preferably a metal or plastic "D"-ring, yet other securing devices may be utilized without limiting the functions of the apparatus 10. Said securing device 87 is attached to a portion outer cap 20 adjacent thereto the additional fastener 85 via attaching thereto a securing material 89 which is further secured to the inside portion of the outer cap 20 therewith sewing techniques 70.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1 through 5.

The method of installing and utilizing the apparatus 10 may be achieved by performing the following steps: acquiring the apparatus 10; detaching the loop fasteners 54, 56, 58 thereon the inner cap 50 from the hook fasteners 40, 42, 44 thereon the outer cap 20; opening a desired amount of pockets 26, thereby unfastening the pocket fasteners 28 and lifting the pocket flaps 27 upwardly; inserting a weight 60 thereinto a desired pocket 26 until a desired amount of weights 60 are inserted into said desired amount of pockets 26; pressing the pocket flap 27 down thereupon the pocket 27 and fastening the pocket fasteners 28; attaching the inner cap 50 to the outer cap 20, thereby aligning and fastening the top hook fastener 40 with the top loop fastener 54, aligning and fastening the middle hook fasteners 42 with the middle loop fasteners 56, and aligning and fastening the bottom hook fasteners 44 with the bottom loop fasteners 58; utilizing the stretchable band 30 to stretch the apparatus 10 onto a top portion of a user's head in order to accommodate said user's head; and, strengthening neck muscles, thereby wearing said apparatus 10.

An alternate method of installing and utilizing the apparatus 10 may be achieved by performing the following steps: acquiring the apparatus 10; detaching the loop fasteners 54, 56, 58 thereon the inner cap 50 from the hook fasteners 40, 42, 44 thereon the outer cap 20; opening a desired amount of pockets 26, thereby unfastening the pocket fasteners 28 and lifting the pocket flaps 27 upwardly; inserting a weight 60 thereinto a desired pocket 26 until a desired amount of weights 60 are inserted into said desired amount of pockets 26; pressing the pocket flap 27 down thereupon the pocket 27 and fastening the pocket fasteners 28; attaching the inner cap 50 to the outer cap 20, thereby aligning and fastening the top hook fastener 40 with the top loop fastener 54, aligning and fastening the middle hook fasteners 42 with the middle loop fasteners 56, and aligning and fastening the bottom hook fasteners 44 with the bottom loop fasteners 58; utilizing the stretchable band 30 to stretch the apparatus 10 onto a top portion of a user's head in order to accommodate said user's head; utilizing the additional securing means 80 thereto add additional support to the apparatus 10, thereby inserting the additional fastener 85 through the securing device 87 and fastening the additional fastener 85 thereto itself; and, strengthening neck muscles, thereby wearing said apparatus 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. Headgear, comprising:

an outer cap, comprising an outer portion and an inner portion;

an inner cap removably attachable to said outer cap with a plurality of fastening means, comprising an inner portion and an outer portion;

a securing means for securing said headgear to a head of a user;

a plurality of pockets located on said inner surface of said outer cap, each comprising:

a strap having a first end attached to a pinnacle portion of said inner portion of said outer cap; and, a weight holder attached to a second end of said strap, further comprising an interior portion; and, a plurality of weights each selectively insertable therein one of said plurality of pockets;

wherein each of said plurality of pockets radiate downwardly from said pinnacle portion;

wherein said interior portion retains one of said plurality of weights therein; and, wherein said headgear provides a strengthening means to neck muscles of said user when worn.

2. The headgear of claim 1, wherein said outer cap further comprises a plurality of apertures each reinforced with a grommet, thereby providing ventilation to said headgear.

3. The headgear of claim 1, wherein said securing means further comprises an adjustable elastic band encompassing a lower portion of said inner portion of said outer cap.

4. The headgear of claim 1, wherein said securing means further comprises:

a first fastener secured within a first lower portion of a rear location of said inner portion of said outer cap and extending outward;

a second fastener secured within a second lower portion of said rear location of said inner portion of said outer cap and extending outward; and, a buckle located on a distal end of said second fastener;

wherein said first fastener is routed through said buckle and fastened to said second fastener.

5. The headgear of claim 1, wherein said outer portion of said outer cap further comprises a fleece material and said inner portion of said outer surface comprises a mesh material.

6. The headgear of claim 1, wherein said outer cap comprises one of the following list: a skull cap and a snow hat.

7. The headgear of claim 1, wherein said inner cap further comprises a moisture-wicking synthetic material, thereby enabling absorption of moisture away from a head of said user when worn.

8. The headgear of claim 1, wherein said plurality of fastening means further comprises:

a plurality of outer fasteners located on:

said pinnacle portion of said inner portion of said outer cap;

an intermediate portion of said inner portion of said outer cap; and, a bottom portion of said inner portion of said outer cap;

a plurality of inner fasteners located on:

a pinnacle portion of said outer portion of said inner cap;

an intermediate portion of said outer portion of said inner cap; and, a bottom portion of said outer portion of said inner cap;

wherein said plurality of outer fasteners correspondingly mate with said plurality of inner fasteners to removably attach said inner cap to said outer cap.

9. The headgear of claim 8, wherein said plurality of outer fasteners and said plurality of inner fastener each comprises a hook-and-loop-type fastener.

10. The headgear of claim 1, wherein said plurality of pockets each further comprises a secure closure for said weight holder;

wherein said secure closure secures each of said plurality of weights therein said weight holder.

11. The headgear of claim 1, wherein said plurality of weights each further comprises a rectangular body with an arcuate shape;

wherein said weight body is shaped to comfortably contour to said head of said user.

12. The headgear of claim 11, wherein said plurality of weights each further comprises a weight of six-and-four-fifths ounces.

13. Headgear, comprising:

an outer cap, comprising an outer portion and an inner portion and a plurality of apertures each reinforced with a grommet, thereby providing ventilation to said headgear;

an inner cap, comprising an inner portion and an outer portion;

a plurality of hook-and-loop-type fasteners for removably attaching said inner cap to said outer cap, further comprising:

a plurality of outer fasteners located on:

a pinnacle portion of said inner portion of said outer cap;

an intermediate portion of said inner portion of said outer cap; and, a bottom portion of said inner portion of said outer cap;

a plurality of inner fasteners, each correspondingly mating with said plurality of outer fasteners located on:

a pinnacle portion of said outer portion of said inner cap;

an intermediate portion of said outer portion of said inner cap; and, a bottom portion of said outer portion of said inner cap;

a securing means for securing said headgear to a head of a user;

a plurality of pockets located on said inner surface of said outer cap, each further comprising:

a strap having a first end attached to said pinnacle portion of said inner portion of said outer cap;

a weight holder attached to a second end of said strap, further comprising an interior portion; and, a secure closure for said weight holder;

wherein each of said plurality of pockets radiate downwardly from said pinnacle portion of said inner portion of said outer cap; and, a plurality of weights each selectively insertable therein one of said plurality of pockets and further comprising a rectangular body with an arcuate shape;

wherein said headgear provides a strengthening means to neck muscles of said user when worn.

14. The headgear of claim 13, wherein said securing means further comprises an adjustable elastic band encompassing a lower portion of said inner portion of said outer cap.

15. The headgear of claim 13, wherein said securing means further comprises:

a first fastener secured within a first lower portion of a rear location of said inner portion of said outer cap and extending outward;

a second fastener secured within a second lower portion of said rear location of said inner portion of said outer cap and extending outward; and, a buckle located on a distal end of said second fastener;

wherein said first fastener is routed through said buckle and fastened to said second fastener.

16. The headgear of claim 13, wherein said outer portion of said outer cap further comprises a fleece material and said inner portion of said outer cap comprises a mesh material.

17. The headgear of claim 13, wherein said outer cap comprises one of the following list: a skull cap and a snow hat.

18. The headgear of claim 13, wherein said inner cap further comprises a moisture-wicking synthetic material, thereby enabling absorption of moisture away from a head of said user when worn.

19. The headgear of claim 13, wherein said plurality of weights each further comprises a weight of six-and-four-fifths ounces.

* * * * *